United States Patent [19]

Nunning et al.

[11] Patent Number: 4,721,650

[45] Date of Patent: Jan. 26, 1988

[54] PARTIALLY ORIENTED NYLON YARN AND PROCESS

[75] Inventors: Walter J. Nunning, Pensacola, Fla.; LeMoyne W. Plischke, Lillian, Ala.; Dror Selivansky, Pensacola, Fla.; John H. Southern, Pensacola, Fla.; Chester C. Wu, Pensacola, Fla.

[73] Assignee: Monsanto Company, St. Louis, Mo.

[21] Appl. No.: 942,888

[22] Filed: Dec. 17, 1986

Related U.S. Application Data

[63] Continuation-in-part of Ser. No. 690,705, Jan. 11, 1985, abandoned.

[51] Int. Cl.[4] ..... D02G 3/00

[52] U.S. Cl. ..... 428/369; 428/364; 428/372; 428/373

[58] Field of Search ..... 428/364, 369, 372, 373; 525/420; 528/342, 335, 272

[56] References Cited

U.S. PATENT DOCUMENTS

| | | | |
|---|---|---|---|
| 2,863,857 | 12/1958 | Costain et al. | 528/342 X |
| 3,304,289 | 2/1967 | Ballentine et al. | 528/342 |
| 3,475,895 | 1/1969 | Raschle | 57/77.3 |
| 3,687,904 | 8/1972 | Middleton | 260/78 |
| 3,885,378 | 5/1975 | Schuster | 57/77.4 |
| 3,973,383 | 8/1976 | Yu | 57/77.4 |
| 3,994,121 | 11/1976 | Adams | 528/335 |
| 4,012,896 | 3/1977 | Fischbach | 57/77.4 |
| 4,093,147 | 6/1978 | Bromley et al. | 428/397 X |
| 4,123,492 | 10/1978 | McNamara et al. | 264/210.5 |
| 4,181,697 | 1/1980 | Koschinek et al. | 264/176 F |
| 4,446,299 | 5/1984 | Koschinke et al. | 528/272 |
| 4,583,357 | 4/1986 | Chamberlin et al. | 428/373 |

*Primary Examiner*—Lorraine T. Kendell

*Attorney, Agent, or Firm*—Thomas N. Wallin

[57] ABSTRACT

A polyamide (preferably nylon 66) partially oriented feed yarn contains a small amount of branching agent and has an elongation between 45 and 150%. The feed yarn can be textured by the friction twist process to yield a textured yarn having crimp development similar to yarn textured by the much more expensive pin twist method.

22 Claims, 2 Drawing Figures

PARTIALLY ORIENTED NYLON YARN AND PROCESS

Figure 1:
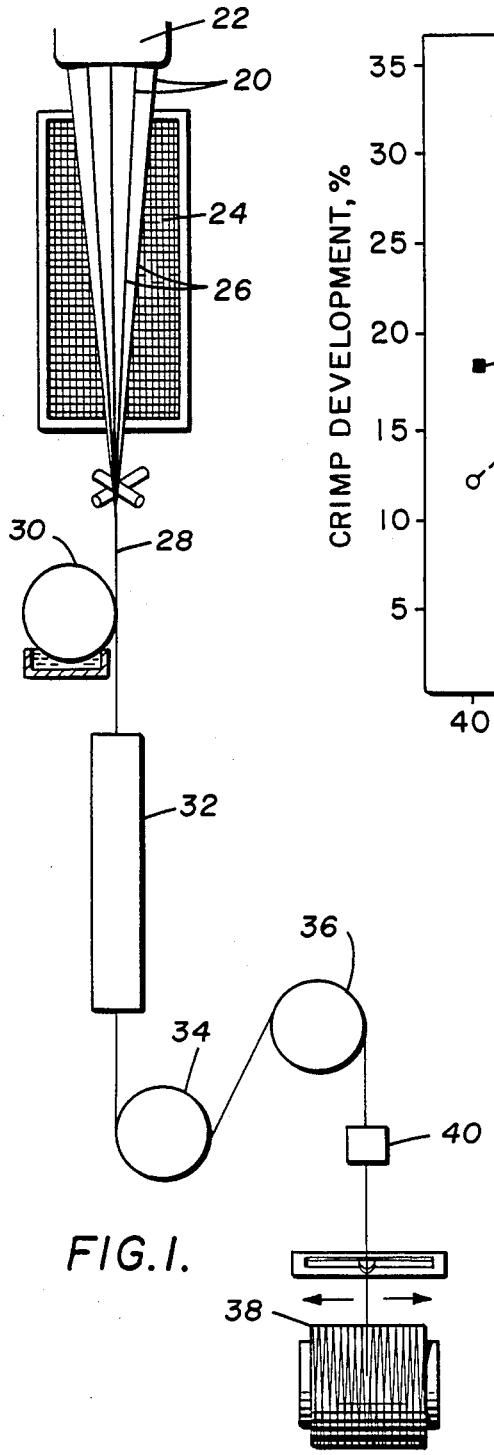

This application is a continuation in part of U.S. patent application Ser. No. 690,705 filed Jan. 11, 1985.

As used in the specification and claims, the term "nylon 66" means those synthetic polyamides containing in the polymer molecule at least 85% by weight of recurring structural units of the formula

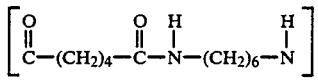

Historically, certain nylon 66 apparel yarns were spun at low speeds of up to about 1400 meters per minute and packaged. The spun yarns were then drawn on a second machine and packaged again. The drawn yarn was then false-twist textured at slow speeds of the order of 55–230 meters per minute by the pin-twist method, yielding a very high quality stretch yarn suitable for stretch garments such as leotards. An exemplary false-twisting element for the pin-twist texturing process is disclosed in Raschle U.S. Pat. No. 3,475,895.

More recently, various other types of false twisting apparatus have come into commercial use, and are collectively referred to as "friction-twist". Some of the most widely used of these include a disc aggregate of the general type illustrated in U.S. Pat. Nos. 3,973,383, Yu, 4,012,896 to Fishbach or 3,885,378 to Schuster. Friction-twisting permits considerably higher texuring speeds than pin-twisting, with yarn speeds currently at about 700–900 mpm. Such high texturing speeds are more economical than those attained by the pin-twist process.

Along with the shift to friction-twisting has come a shift to partially-oriented nylon 66 (PON) yarns as the feeder yarns for the friction-twist process. In the conventional PON spinning process, the winding speed is merely increased from the previous standard of about 900–1500 meters per minute to speeds generally in the 2750–4000 meters per minute range, resulting in a PON yarn. PON yarn performs better in the high speed friction-twist texturing process than either the earlier drawn yarn or the low-speed spun yarn mentioned above. However, heretofore yarns textured by the friction-twist process were of distinctly lower quality in terms of crimp development than yarns textured by the pin-twist process. The apparel nylon 66 false-twist textured yarn market is accordingly in essentially two distinct segments: the older, expensive, high quality pin-twist yarns, and the newer, less costly, lower quality friction-twist yarns.

Conventional PON feeder yarns for false-twist texturing have had R.V.'s in the range from the middle or upper thirties to the low forties, as indicated by U.S. Pat. No. 3,994,121. More recently, Chamberlin et al. U.S. patent application Ser. No. 594,522, filed April 2, 1984, (now U.S. Pat. No. 4,583,357) and assigned to the assignee of the present application, discloses that high RV PON feeder yarns are superior to those conventional PON yarns disclosed in U.S. Pat. No. 3,994,121.

According to the present invention there are provided further novel and improved PON feeder yarns permitting manufacture of friction-twist yarns having increased crimp development, in some cases comparable to that of pin-twist yarns, and in some cases superior to the yarns of the noted Chamberlin application. This increased crimp development provides a substantial increase in fabric stretch recovery and covering power as compared to fabrics made from friction-twist yarns made from PON feeder yarns as disclosed by Adams U.S. Pat. No. 3,994,121. Accordingly, less textured yarn is required to provide a fabric of equivalent covering power, or a fabric with increased stretch recovery is produced if the same amount of textured yarn is used. Increased productivity is also provided, and in some cases the conventional heating step prior to packaging disclosed by Adams as being critical is eliminated. The improved productivity is based on an increase in the elongation-to-break of the yarns of this invention as compared to otherwise identical yarns (yarns spun under identical conditions from polymers which are the same except that the branching agent used in yarns of this invention is absent). As is known, for example from U.S. Pat. No. 4,442,057, productivity is proportional to elongation. If a spun filament has a percent elongation-to-break of E, then the maximum draw ratio to which it can subsequently be subjected is roughly $(1+E/100)$. If a second spun filament has a larger elongation-to-break $E'$ then it can be subjected to a larger draw ratio, roughly $(1+E'/100)$. To make drawn filaments of equal decitex d at these maxirum draw ratios, the spun filaments must therefore have decitexes of $d\ (1+E/100)$ and $d(1+E'/100)$ respectively. If both filaments are spun at the same speed, their production rates are proportional to these decitexes and the percentage increase in productivity of the second filament is $$\frac{(1+E'/100)-(1+E/100)}{(1+E/100)} \times 100\%$$

Increases in elongation-to-break of 5% (that is, 5% of the percentage elongation of the yarn containing no branching agent or more are readily determinable by conventional laboratory techniques and are correlatable to significant increases in productivity.

The yarns of the invention are, broadly, false twist texturing feed yarns spun at high speeds and characterized by incorporation in the polymer from which the yarns are spun of small amounts of branching agents. While the mechanism or reason for the improved results of the present invention are not entirely understood, the yarns have increased values of normalized SAXS peak intensity and normalized lamellar dimensional product which are distinctive as compared to conventional PON yarn, and are believed to contribute to the improved results of the present invention. Values of at least 1.1 for each of these properties are generally associated with yarns according to the invention with values of 1.3 being generally preferred and values of at least 1.75 being especially preferred. One possible explanation of the normalized SAXS peak intensity is that it indicates relatively more relaxed amorphous regions and relatively more highly developed crystalline regions in the yarns of the present invention as compared to conventional PON yarn.

According to a first principal aspect of the invention there is provided an apparel yarn suitable for use as a feed yarn for drawtexturing, the yarn having an elongation between 45% and 150% and comprising filaments consisting essentially of a polyamide polymer containing a branching agent in an amount sufficient to provide improved productivity (as evidenced by at least a 5% increase in elongation) and/or crimp development.

According to a second principal aspect of the invention, there is provided a process for melt spinning a polyamide yarn suitable for drawtexturing from a molten polyamide polymer containing a branching agent, the process comprising extruding at a given extrusion rate a plurality of streams of the polymer through spinneret capillaries into a quench zone; quenching the molten streams into filaments; withdrawing the filaments from the quench zone at a spinning speed greater than 2200 MPM; and converging the filaments into a yarn; the polymer, the extrusion rate, and the spinning speed being selected such that the yarn has an elongation between 45% and 150%.

According to further aspects of the invention, the preferred polyamide is nylon 66. Preferably the branching agent constitutes between 0.01 and 1 mol percent of the polymer, and it is especially preferred that the branching agent constitute between 0.05 and 0.25 mol percent of the polymer. In the spinning process, better yarn properties are sometimes noted if the yarn is stretched at a draw ratio between 1.01 and 1.6 immediately after solidification and prior to being wound. Improved results are obtained when the filaments have a normalized SAXS peak intensity greater than 1.1, with still further improved results being obtained when the filaments have a normalized SAXS peak intensity greater than 1.75. Filaments of the invention generally have a normalized lamellar dimensional product of at least 1.1, with superior products having a normalized lamellar dimensional product of at least 1.75. If the polymer is to be melted on a conventional grid prior to the step of extruding, the polymer RV is advantageously less than 60 (preferably between 40 and 55), while if an extruder is used to melt the polymer, the polymer RV is preferably between 50 and 80.

Figure 2:
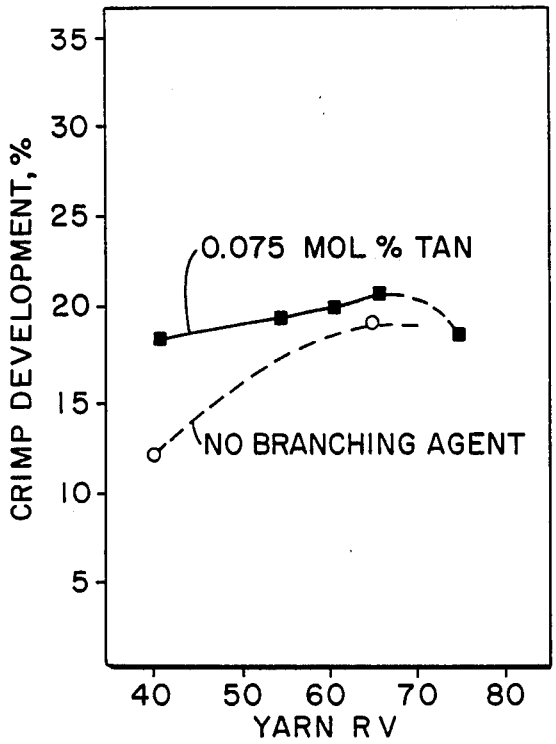

Other aspects will in part appear hereinafter and will in part be apparent from the following detailed description taken together with the accompanying drawings, wherein:

FIG. 1 is a schematic front elevation view of an exemplary spinning position for making PON yarns according to the invention; and FIG. 2 is a graph showing crimp development of yarns of the present invention as compared to various other yarns.

As shown in FIG. 1, molten streams 20 of nylon 66 polymer are extruded through capillaries in spinneret 22 downwardly into quench zone 24 supplied with transversely directed quenching air at room temperature. Streams 20 solidify into filaments at some distance below the spinneret within the quench zone. Filaments 26 are converged to form yarn 28 below quench zone 24. A conventional spin-finish is applied to yarn 28 by finish applicator 30. If desired, the filaments may be converged simultaneously with application of the finish. Yarn 28 next passes through interfloor conditioner tube 32 and in partial wraps about godet 34 and 36 prior to being wound on bobbin 38. The filaments may be entangled if desired, as by pneumatic tangle chamber 40.

Ordinarily, godets 34 and 36 perform the functions of withdrawing filaments 26 from quench zone 24 at a spinning speed determined by the peripheral speed of godet 34, and of reducing the tension in yarn 28 from the rather high level just prior to godet 34 to an acceptable level for winding onto package or bobbin 8. The winding tension range of 0.03 to 0.25 grams per denier is preferred, with tensions of about 0.1 grams per denier being particularly preferred. Godets 34 and 36 may be dispensed with if the yarn winding tension immediately prior to the winder in the absence of the godets is within the yarn tension ranges indicated in this paragraph. "Winding tension" as used herein means the yarn tension as measured just prior to the yarn traversing and winding mechanism. Some commercially available winders include an auxiliary roll designed to both assist in yarn traversing and to permit reducing the yarn tension as the yarn is wound onto the bobbin or package. Such winders may be of assistance when using the upper portions of the yarn tension ranges indicated in the paragraph.

EXAMPLE 1

Spinneret 22 contains 34 capillaries having lengths of 0.012" (0.3 mm.) and diameters of 0.009" (0.229 mm.). Quench zone 24 is 44 inches in height, an is supplied with 18° C. quench air having an average horizontal velocity of about 1 foot (30.5 cm.) per second. Filaments 26 are converged into yarn 28 about 37.5 inches (95 cm.) below the spinneret, and conventional spin finish is applied to yarn 28 by finish applicator 30. Conditioner tube 2 is 77 inches (183 cm.) long and is of the type disclosed in Koschinek U.S. Pat. No. 4,181,697, i.e., a steamless tube heated to 120° C. through which yarn 28 passes. The speed of godets 34 and 36 are 3500 meters per minute and 3535 meters per minute, respectively, to prevent the yarn from wrapping on godet 34. The winder used is the Barmag SW4SLD, and the winder speed is adjusted to provide a winding tension of 0.1 grams per denier. Four different nylon 66 polymers are spun at a temperature of about 295° C. into PON yarns with polymer metering rates selected such that the final drawtextured yarns have nominal deniers of about 70. All polymers contain between 0.1 and 0.35 mol % acetic acid as a viscosity stabilizer, and in this range of concentration the level of acetic acid has little effect on yarn properties.

Item 1 is a control within the range of conventional commercial PON practice, having no branching agent. Yarn RVs and amounts of branching agent are given below in Table 1. The PON elongations for items 1–4 are, respectively, 71%, 97%, 91%, and 109%. Normalized lamellar dimensional products for items 2 and 4 are 2.4 and 3.1 respectively, while normalized SAXS peak intensities for items 2 and 4 are 6.1 and 11.8 respectively. Normalized lamellar dimensional product and normalized SAXS peak intensity for item 1 are each approximately 1.0. The data indicates a substantial increase in crimp development (% CD) by incorporating a small amount of branching agent in the polymer.

The spun yarns are then simultaneously drawn and friction-twist textured on a texturing machine using a 2½ meter primary heater and a Barmag disc-aggregate with Kyocera ceramic discs in a draw zone between a feed and a draw or mid roll. The heater temperature is 230° C., and the ratio of the peripheral speed of the discs to draw roll speed (the D/Y ratio) is 1.910. The draw roll speed is set at 800 meters per minute, and the feed roll speed is adjusted to some lower speed to control the draw ratio and hence the draw-texturing tension (the yarn tension between the exit of the heater and the aggregate). In order to maximize the crimp development, the draw ratio is changed by adjustment of the feed roll speed so that the drawtexturing tension is high enough for stability in the false twist zone and yet low enough that the filaments are not broken, this being the operable texturing tension range. Within the operable tension range, the "maximum texturing tension" is defined as the tension producing the maximum initial crimp development without an unacceptable level of broken filaments (frays). More than 10 broken filaments per kilogram are unacceptable in commercial use.

With these yarns, the operable texturing tension range is quite narrow when draw-texturing at 800 meters per minute. The maximum texturing tension is found to be about 0.43 grams per draw roll denier. The draw roll denier is defined as the spun yarn denier divided by the mechanical draw ratio provided by the different surface speeds of the feed roll feeding the yarn to the heater and of the draw or mid roll just downstream of the false-twist device. When the texturing tension is more than 0.45 grams per draw roll denier, an unacceptable level of broken filament is produced.

Properties of the textured yarns measured about 2 weeks after texturing are given in Table 1.

TABLE 1

| ITEM | % TAN | % CD | RV | FRAYS | STRESS | DENIER | ELONG. | TEN. |
|---|---|---|---|---|---|---|---|---|
| 1 | 0.0 | 14 | 43 | 1.3 | 0.43 | 71 | 20 | 4.53 |
| 2 | 0.075 | 17 | 55 | 1.1 | 0.43 | 73 | 23 | 4.47 |
| 3 | 0.10 | 15 | 52 | 0.9 | 0.42 | 73 | 22 | 4.53 |
| 4 | 0.125 | 19 | 58 | 3.0 | 0.42 | 73 | 23 | 3.93 |

In the table, "Elong." means elongation in percent, while "Ten." means tenacity in grams per denier. "Stress" is the texturing tension in grams per draw roll denier. "% TAN" is the mol % of the trifunctional branching agent 4(aminomethyl)-1,8-diaminooctane (referred to herein as "TAN") incorporated in the polymer. TAN has the following structural formula:

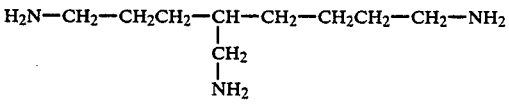

A decrease in textured yarn tenacity is indicated at the highest level in Table 1 (0.125 mol %), suggesting that higher levels of branching agent may involve a reduction in tenacity below the level required by some end uses. Furthermore Item 4 above exhibits a severe bobbin crushing problem, crushing the bobbin on the winder chuck after about 10–20 minutes run time. When repeating Item 4 with no heat applied in tube 32, four hour doffs are possible without crushing the bobbin. In this case the crimp development obtained is 18%, and the textured yarn tenacity is 3.97. It is accordingly preferred to use TAN at a level of about 0.075 to about 0.10 mol %, or to apply heat in tube 32. That is, the use of TAN in this manner avoids requirements for heat conditioning.

EXAMPLE 2

This qualitatively illustrates the effect of PON yarn RV on crimp development in the textured yarn, both with and without a branching agent according to the present invention. Flake from modified nylon 66 polymers having different RVs and containing 0.075 mol percent TAN are spun as in Example 1 above, with the PON yarn denier selected such that the drawtextured yarn has 70 denier. The PON yarns are textured under the conditions used for Example 1 above. The textured yarns are aged on the bobbin for 2–3 weeks and the resulting crimp development is compared to similarly aged textured yarns made from conventional linear (i.e., without a branching agent) 40 RV PON and linear 65 RV PON in FIG. 2. As illustrated, the present yarns provide for greatly increased crimp development as compared to conventional 40 RV linear PON, and, with comparable RV's up to about 65 or 70, provide equivalent or somewhat higher crimp development than yarns made with high RV linear polymer. PON yarns with a branching agent and having RV's lower than about 55 or so can be spun using a conventional melt grid, and do not require a screw extruder or the like as does, for example, 65 or 70 RV PON without a branching agent.

While the above examples use TAN for exemplifying the invention, numerous other branching agents may be used. Bishexaethylene triamine is an alternative branching agent. Trimesic acid is an example of a material reactive with the amine end groups in the polymer. Any necessary adjustment in the amount of branching agent can readily be done by trial and error. Suitable branching agents generally contain three or more functional groups reactive with amine or carboxylic end groups under the conditions used for polymerizing the polymer, and generally increase the polymer RV. Alpha-amino-epsilon-caprolactam is noted as another suitable material which under polymerizing conditions has the requisite minimum number of reactive functional groups. If the branching agent contains more than three such functional groups, it may be necessary to reduce the level of branching agent significantly below those indicated above as preferred with TAN.

TEST METHODS

All yarn packages to be tested are conditioned at 21 degrees C. and 65% relative humidity for one day prior to testing.

The yarn elongation-to-break is measured one week after spinning. Fifty yards of yarn are stripped from the bobbin and discarded. Elongation-to-break is determined using an Instron tensile testing instrument. The gage length (initial length) of yarn sample between clamps on the instrument) is 25 cm., and the crosshead speed is 30 cm. per minute. The yarn is extended until it breaks. Elongation-to-break (or elongation) is defined as the increase in sample length at the time of maximum load or force (stress) applied, expressed as a percentage of the original gage length (25 cm.).

Crimp development is measured as follows. Yarn is wound at a positive tension less than 2 grams on a Suter denier reel or equivalent to provide a 1⅛ meter circumference skein. The number of reel revolutions is determined by 2840/yarn denier, to the nearest revolution. This provides a skein of approximately 5680 skein denier and an initial skein length of 9/16 meter. A 14.2 gram weight or load is suspended from the skein, and the loaded skein is placed in a forced-air oven maintained at 180° C. for 5 minutes. The skein is then removed from the oven and conditioned for 1 minute at room temperature with the 14.2 gram weight still suspended from the skein, at which time the skein length $L_2$ is measured to the nearest 0.1 cm. The 14.2 gram weight is then replaced with a 650 gram weight. Thirty seconds after the 650 gram weight is applied to the skein, the skein length $L_3$ is measured to the nearest 0.1 cm. Percentage crimp development is defined as $(L_3-L_2)L_3\times 100$. Crimp development decreases with time as the textured yarn ages on the bobbin, rapidly for the first hours and days, then more slowly. Normalized crimp development is the ratio of the crimp development of the yarn sample to that of a 40 RV reference yarn of the same denier and denier per filament spun and textured under the same conditions as the yarn sample, with both crimp development values being determined 14 days after the yarns are textured.

Relative viscosity (RV) is determined by ASTM D789-81, using 90% formic acid.

Broken filaments are determined visually, by counting the number of broken filaments on the exposed surfaces of the package.

The reference polymer is nylon 66 formed from stoichiometric amounts of hexamethylene diamine and adipic acid, further containing as the sole additives 44 parts per million manganese hypophosphite monohydrate, 898 parts per million acetic acid as a molecular weight stabilizer and 3000 parts per million titanium dioxide pigment, all parts being parts by weight. Polymerization is conventional, to provide a nominal polymer RV of 38–40.

The reference yarn is prepared by appropriately adjusting the moisture level in the reference polymer, then spinning under the same spinning conditions as the yarn being tested to provide a 40 RV reference yarn having the same denier and denier per filament as the yarn sample being tested.

X-RAY TECHNIQUES

The X-ray diffraction patterns (small angle X-ray scattering, or SAXS) are recorded on NS54T Kodak no-screen medical X-ray film using evacuated flat plate Laue cameras (Statton type). Specimen to film distance is 32.0 cm.; incident beam collimator length is 3.0 inches, exposure time is 8 hours. Interchangeable Statton type yarn holders with 0.5 mm. diameter pinholes and 0.5 mm. yarn sheath thickness are used throughout as well as 0.5 mm. entrance pinholes. The filaments of each sheath of yarn are aligned parallel to one another and perpendicular to the X-ray beam. A copper fine focus X-ray tube ($\lambda=1.5418$ Å) is used with a nickel filter at 40 KV and 26.26 MA, 85% of their rated load. For each X-ray exposure a single film is used in the film cassette. This film is evaluated on a scanning P-1000 Obtronics Densitometer for information concerning scattering intensity and discrete scattering distribution characteristics in the equatorial and meridional directions. A curve fitting procedure, using Pearson VII functions [see M. H. Heuvel and R. Huisman, *J. Appl. Poly. Sci.*, 22, 2229–2243 (1978)] together with a second order polynomial background function, is used to fit the experimental data prior to calculation. A meridional scan is performed, the discrete scattering fitted, equatorial scans are performed through each discrete scattering maxima and then again the data is fitted via a parameter fit procedure.

The peak height intensity is taken as an average of the four fitted intensity distributions (i.e., the two mirrored discrete scattering distributions in the meridional directions and the two equatorial distributions through these meridional maxima). The normalized SAXS peak intensity is then simply the ratio of the measured peak intensity to that of the measured peak intensity of a 40 RV reference yarn of the same denier and denier per filament spun under the same conditions.

The SAXS discrete scattering X-ray diffraction maxima are used to determine the average lamellar dimensions. In the meridional direction this is taken here to be the average size of the lamellar scattered in the fiber direction and in the equatorial direction, the average size of the lamellar scattered in a direction perpendicular to the fiber direction. These sizes are estimated from the breadth of the diffraction maxima using Scherrer's method, $$D\ (\text{meridional or equatorial})=K\lambda/\beta\cos\theta,$$

where K is the shape factor depending on the way $\beta$ is determined, as discussed below, $\lambda$ is the X-ray wave length, in this case 1.5418 Å, $\theta$ is the Bragg angle, and $\beta$ the spot width of the discrete scattering in radians, $$\beta(\text{meridional})=2\theta_D-2\theta,$$

where $$2\theta_D(\text{radians})=\text{Arctan}\ [(HW+w)/2r]$$

$$2\theta_\beta(\text{radians})=\text{Arctan}\ [(HW-w)/2r]$$

r = the fiber to film distance 320 mm.

w = the corrected half width of the scattering as discussed below

HW = peak to peak distance (mm.) between discrete scattering maxima

The Scherrer equation is again used to calculate the size of the lamellar scattered in the equatorial direction through the discrete scattering maxima, $$(\text{equatorial})=2\ \text{Arctan}\ (w/r^*)$$

where $$r^*=(HW/2)^2+(320)^2\ ^{\frac{1}{2}}$$

Warren's correction for line broadening due to instrumental effects is used as a correction for Scherrer's line broadening equation, $$W_m{}^2=w^2+W^2$$

where $W_m$ is the measured line width, W = 0.39 mm. is the instrumental contribution obtained from inorganic standards, and w is the corrected line width (either in the equatorial or meridional directions) used to calculate the spot width in radians, $\beta$. The measured line width ($W_m$ is taken as the width at which the diffraction intensity on a given film falls to a value of one-half the maximum intensity and is the half width parameter of the curve fitting procedure. Correspondingly, a value of 0.90 is employed for the shape factor K in Scherrer's equations. Any broadening due to variation of periodicity is neglected.

The lamellar dimensional product is given then by $$LDP=D(meridional)\times D(equatorial)$$

and the normalized lamellar dimensional product is then simply the ratio of the lamellar dimensional product to that of a 40 RV reference yarn of the same denier and denier per filament spun under the same conditions.

What is claimed is:

1. An apparel yarn suitable for use as a feed yarn for drawtexturing, said yarn having an elongation betwee 45% and 150% and comprising filaments consisting essentially of nylon 66 polymer containing between 0.01 and 1 mole percent of a branching agent and having an elongation at least 5% greater than that of an otherwise identical yarn containing no branching agent.

2. The yarn defined in claim 1, wherein said branching agent constitutes between 0.05 and 0.15 mol percent of said polymer.

3. The yarn defined in claim 1, wherein said yarn was spun at a spinning speed greater than 2200 MPM.

4. The yarn defined in claim 1, wherein said filaments have a normalized SAXS peak intensity greater than 1.1.

5. The yarn defined in claim 1, wherein said filaments have a normalized SAXS peak intensity greater than 1.3.

6. The yarn defined in claim 1, wherein said filaments have a normalized SAXS peak intensity greater than 1.75.

7. The yarn defined in claim 1, wherein said filaments have a lamellar dimensional product of at least 1.1.

8. The yarn defined in claim 5, wherein said filaments have a lamellar dimensional product of at least 1.3.

9. The yarn defined in claim 6, wherein said filaments have a lamellar dimensional product of at least 1.3.

10. The yarn defined in claim 6, wherein said filaments have a lamellar dimensional product of at least 1.75.

11. The yarn defined in claim 1, wherein said branching agent is a trifunctional amine.

12. The yarn defined in claim 1, wherein said branching agent is TAN.

13. The yarn defined in claim 1, wherein said branching agent is bis-hexamethylene triamine.

14. The yarn defined in claim 1, wherein said branching agent is a trifunctional acid.

15. The yarn defined in claim 1, wherein said branching agent is trimesic acid.

16. An apparel yarn suitable for use as a feed yarn for drawtexturing, said yarn having an elongation between 45% and 150%, comprising filaments consisting essentially of nylon 66 polymer containing between 0.01 and 1 mole percent branching agent and having a normalized crimp development of at least 1.05.

17. The yarn of claim 16 wherein said filaments have a normalized SAXS peak intensity greater than 1.1 and a lamellar dimensional product of at least 1.3.

18. The yarn of claim 17 wherein said normalized SAXS peak intensity is greater than 1.75.

19. The yarn of claim 17 wherein the branching agent is a trifunctional amine.

20. The yarn of claim 19 wherein the branching agent is TAN.

21. The yarn of claim 19 wherein the branching agent is bis-hexamethylene amine.

22. The yarn of claim 19 wherein the branching agent is trimesic acid.

* * * * *